US006814302B2

(12) United States Patent
Stoecklein et al.

(10) Patent No.: US 6,814,302 B2
(45) Date of Patent: Nov. 9, 2004

(54) ACCUMULATOR FUEL-INJECTION SYSTEM FOR AN INTERNAL COMBUSTION ENGINE

(75) Inventors: Wolfgang Stoecklein, Stuttgart (DE); Dietmar Schmieder, Markgroeningen (DE)

(73) Assignee: Robert Bosch GmbH, Stuttgart (DE)

( * ) Notice: Subject to any disclaimer, the term of this patent is extended or adjusted under 35 U.S.C. 154(b) by 254 days.

(21) Appl. No.: 10/048,737

(22) PCT Filed: Mar. 24, 2001

(86) PCT No.: PCT/DE01/01159

§ 371 (c)(1),
(2), (4) Date: Apr. 29, 2002

(87) PCT Pub. No.: WO01/88366

PCT Pub. Date: Nov. 22, 2001

(65) Prior Publication Data

US 2002/0134853 A1 Sep. 26, 2002

(30) Foreign Application Priority Data

May 18, 2000 (DE) ..... 100 24 702

(51) Int. Cl.[7] ..... B05B 3/00; B05B 1/30; F02M 47/02; F02M 39/00

(52) U.S. Cl. ..... 239/98; 239/88; 239/533.2; 239/533.3; 239/585.1; 239/585.2

(58) Field of Search ..... 239/88, 89, 90, 239/91, 92, 93, 94, 98, 533.2, 533.3, 533.8, 533.9, 585.1, 585.2, 585.3, 585.4, 585.5; 251/129.15, 129.21

(56) References Cited

U.S. PATENT DOCUMENTS 4,605,166 A * 8/1986 Kelly ..... 239/96
5,484,104 A * 1/1996 Kukler ..... 239/87
6,412,706 B1 * 7/2002 Guerrassi et al. ..... 239/96

FOREIGN PATENT DOCUMENTS

| | | |
|---|---|---|
| DE | 198 37 890 A | 2/2000 |
| GB | 2 336 627 A | 10/1999 |
| GB | 2 340 610 A | 2/2000 |

* cited by examiner

*Primary Examiner*—Davis Hwu
(74) *Attorney, Agent, or Firm*—Michael J. Striker

(57) ABSTRACT

An injection device for a fuel reservoir injection system is proposed, having an injection nozzle (16), which protrudes into a combustion chamber and can be supplied with fuel from a high-pressure fuel distributor (10) by means of a high-pressure fuel supply path (14, 52, 44, 40), and having a nozzle needle (30), which opens and closes this injection nozzle (16) as a function of the pressure in a control chamber (58). In order to introduce fuel into the control chamber, an inlet conduit (62), which branches from the fuel supply path, feeds into this control chamber (58) and an outlet path (66, 78), which leads from this control chamber (58), permits fuel to flow out of the control chamber. A shutoff valve (70) can close a downstream section (66") off from an upstream section (66') of the outlet path. The downstream section and the upstream section of the outlet path feed into a valve chamber (78), which contains a movable shutoff element (76). A bypass conduit (74), which feeds into the outlet path, branches from the fuel supply path in order to introduce an additional fuel flow into the control chamber. In order to minimally interfere with the flow behavior in the outflow of fuel, the infeed point of the bypass conduit into the outlet path is disposed in the vicinity of the valve chamber

6 Claims, 1 Drawing Sheet

ACCUMULATOR FUEL-INJECTION SYSTEM FOR AN INTERNAL COMBUSTION ENGINE

BACKGROUND OF THE INVENTION

The invention relates to an injection device for a fuel reservoir injection system of an internal combustion engine.

Injection devices of this kind are sufficiently known from current use. Fuel reservoir injection systems, common rail injection systems for a multi-cylinder internal combustion engine have a high-pressure fuel distributor or rail from which a number of high-pressure fuel supply paths each lead to a respective injection nozzle that protrudes into one of the cylinder combustion chambers of the internal combustion engine.

The fuel injection into the respective combustion chamber is controlled by means of a nozzle needle, which opens and closes the injection nozzle as a function of the pressure in a control chamber. In order to build up pressure in the control chamber, a continuously open inlet conduit is provided, through which the fuel at rail pressure can flow from the respective fuel supply path into the control chamber. Fuel can the released from the control chamber by means of a separate outlet path and can thus bring about a pressure relief in the control chamber. Through intentional opening and closing of a shutoff valve disposed in the outlet path, influence can be exerted on the pressure level in the control chamber and therefore on the position of the nozzle needle.

If the valve is opened, fuel flows out of the control chamber. The attendant pressure drop in the control chamber causes the nozzle needle to lift up from a seat in the injection nozzle and fuel comes out of the injection nozzle. If the valve is closed again, the replenishing flow of fuel arriving via the inlet conduit causes the pressure in the control chamber to build back up again. As a result of this pressure increase, the nozzle needle is pressed against its seat again and closes the injection nozzle. The outlet path and the inlet conduit are embodied so that when the outlet path is open, the flow rate of the fuel flowing out via the outlet path is greater than the flow rate of the replenishing fuel arriving via the inlet conduit, effectively reducing the fuel volume in the control chamber.

The metering precision of the injected fuel quantity is essentially determined by the speed with which the injection nozzle can be opened and closed. In the closing of the nozzle, the comparatively small flow cross section of the inlet conduit can mean that there is not enough of a replenishing fuel flow to achieve sufficiently rapid closing times.

In order nevertheless to be able to compensate for the fuel losses sustained in the control chamber with sufficient speed, one strategy is to provide a bypass conduit that branches from the fuel supply path and feeds into the outlet path. If the shutoff valve is closed, an additional fuel flow can flow through this bypass conduit, out of the fuel supply path and into the control chamber by means of a part of the outlet path in the vicinity of the control chamber. It has turned out that this permits higher closing speeds of the nozzle needle to be achieved.

However, it has also turned out that the feeding of the bypass conduit into the outlet path can cause interference in the flow behavior of the fuel as it flows out of the control chamber. For example, inevitable flow edges at the infeed point can cause turbulence which end ups preventing the fuel quantity required to open the injection nozzle from flowing out of the control chamber with the desired speed.

The delayed opening of the injection nozzle can then have disadvantageous effects on the metering precision.

SUMMARY

According to the invention, the infeed point of the bypass conduit is disposed in the outlet path in the vicinity of the valve chamber. It has turned out that by locating the infeed point here, undesirable interference of the flow behavior of the fuel flowing out of the control chamber can be kept very slight. Since intensified turbulence of the fuel flow must as a rule be reckoned with anyway in the vicinity of the valve chamber, the additional turbulence effect of the flow edges of the infeed point is insignificant by comparison with this other turbulence.

If the bypass conduit is open, provided that there is a pressure difference, fuel flows from the fuel supply path, via the bypass conduit, into the outlet path, and increases the pressure there. Whereas this effect is desirable during the closing of the injection valve in order to fill the control chamber more rapidly, during the opening of the injection valve, the fuel flow being diverted into the outlet path via the bypass conduit can partially hinder the outflow of fuel from the control chamber to a significant degree and can thus lead to a delayed opening of the injection nozzle. The bypass conduit infeed point location according to the invention has also turned out to be advantageous in this regard.

In the vicinity of the valve chamber, there is sufficient freedom of structural design to permit the bypass conduit to feed into the outlet path so that such hindrances to the outflow of fuel can be kept to a minimum. The bypass conduit can therefore easily remain open all the time.

As a rule, an outlet throttle can be disposed in the outlet path, upstream of the valve chamber, and this outlet throttle can be used to set a desired flow of the outflowing fuel. This outlet throttle is preferably spaced apart from the valve chamber along the outlet path.

It is turned out that the embodiment of the region of the outlet path between the outlet throttle and the valve chamber can be of decisive importance to the flow behavior of the outflowing fuel. In particular, through suitable embodiment of his region of the outlet path, cavitation can be produced in the outlet throttle when fuel flows out of the control chamber. Cavitation in the outlet throttle has the advantage that the flow through the outlet throttle is independent of the pressure in the valve chamber and therefore independent of a possible fuel influx via the bypass conduit.

Since according to the invention, the bypass conduit feeds into the valve chamber and the region of the outlet path between the outlet throttle and the valve chamber is consequently free of flow edges, which can be produced by the infeed of the bypass conduit, this region of the outlet path can be more easily optimized design-wise with regard to a desired flow behavior in the fuel outflow than would be the case if the bypass conduit were to feed into the outlet path between the outlet throttle and the valve chamber.

A preferred embodiment of the invention provides that the shutoff element be embodied as a seat element that can be moved in the valve chamber between two opposing valve seats, that the upstream and the downstream sections of the outlet path feed into the valve chamber at the two valve seats, and that the infeed point of the bypass conduit into the valve chamber—with regard to the outflow direction of the fuel—is disposed between the two valve seats.

It goes without saying, though, that an embodiment of the shutoff valve as a piston slide valve or as a single-seat valve is in no way excluded from the scope of the invention.

Other advantages and advantageous embodiments of the subject of the invention can be inferred from the specification, the drawings, and the claims.

An exemplary embodiment of the invention will be explained in detail below in conjunction with the accompanying drawings.

DESCRIPTION OF THE PREFERRED EMBODIMENT

Figure 1:
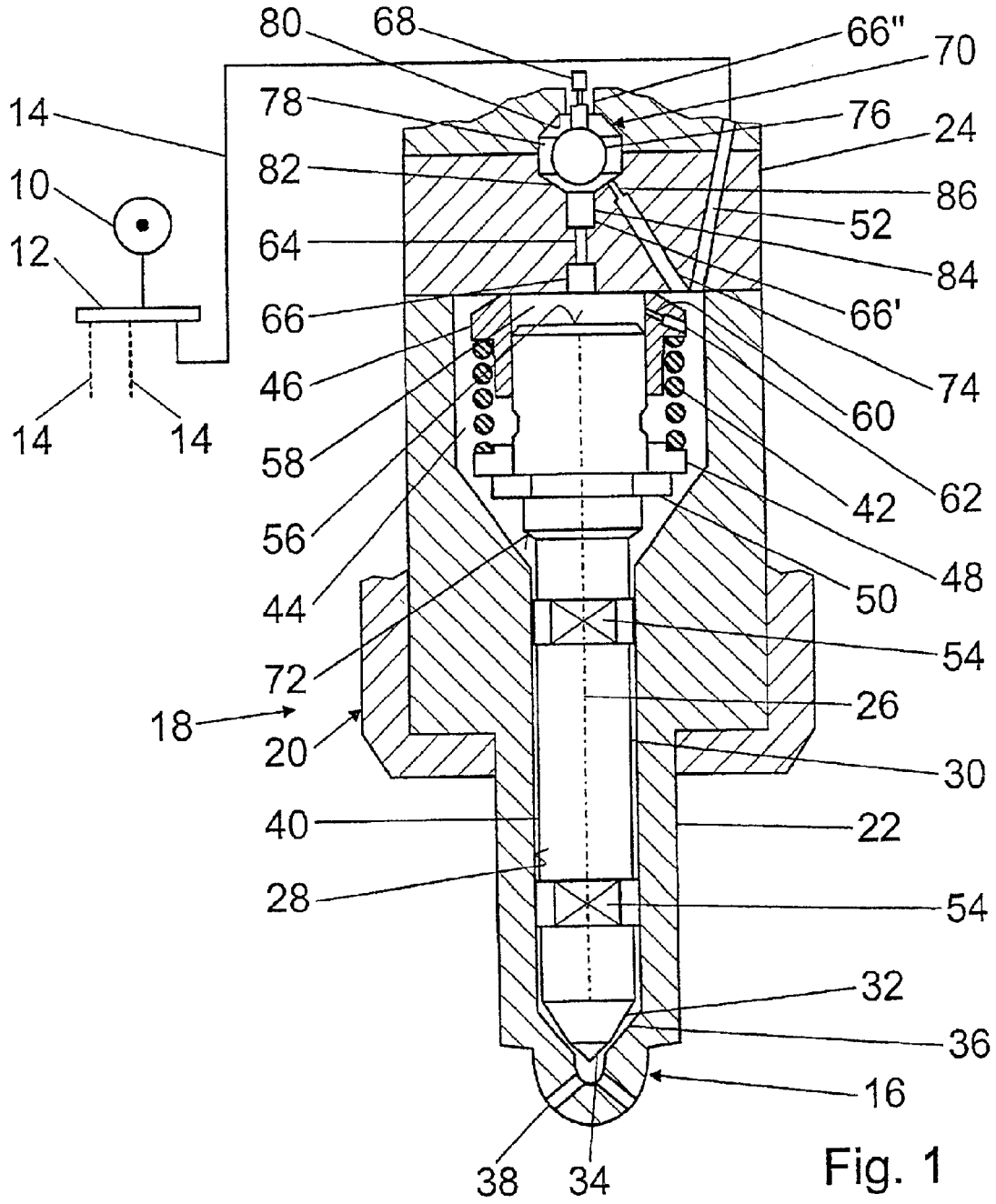
FIG. 1 shows a schematic, longitudinal section through a detail of an injector assembly of a reservoir injection system, and FIG. 2 schematically depicts a quantity characteristic field of the injector assembly according to FIG. 1.

FIG. 1 shows a pressure source 10 of a reservoir injection system that represents a common rail injection system, which supplies diesel fuel at a high pressure of for example more than 1500 bar into a distributor tube or rail 12. A number of fuel supply lines 14 lead from the distributor tube 12 and are each used to supply fuel to a respective injection nozzle 16. The injection nozzle 16 protrudes in a manner not shown in detail into a cylinder combustion chamber of a multi-cylinder internal combustion engine, for example an engine of a motor vehicle. It is part of an injector assembly, labeled as a whole with the numeral 18, which as a unit that can be preassembled, can be inserted into a cylinder block of the internal combustion engine.

The injector assembly 18 has a housing assembly 20 with a nozzle housing 22 and a valve housing 24. A guide bore 28 is embodied in the nozzle housing 22, extending along a housing axis 26, and an elongated nozzle needle 30 is guided so that it can move axially in this guide bore 28. At a needle tip 32, the nozzle needle 30 has a closing face 34 with which it can be brought into sealed contact against a needle seat 36 embodied in the nozzle housing 22.

When the nozzle needle 30 is resting against the needle seat 36, i.e. is disposed in the needle closed position, this stops fuel from coming out of a nozzle opening arrangement 38 at the end of the nozzle housing 22 protruding into the combustion chamber. However, if the needle is lifted up from the needle seat 36, i.e. is disposed in the needle open position, fuel can flow from an annular chamber 40, which is formed between the nozzle needle 30 and the circumference wall of the guide bore 28, past the needle seat 36, to the nozzle opening arrangement 38 and from there, can be injected into the combustion chamber essentially at the high pressure or rail pressure.

The nozzle needle 30 is prestressed in the direction of its closed position by means of a prestressing spring 42. The prestressing spring 42 is accommodated in a spring chamber 44 embodied in the nozzle housing 22. At one end, this spring is supported against the housing assembly 20 by means of a sleeve 46 that contains the end of the nozzle needle 30 remote from the combustion chamber in a sealed, but axially mobile fashion and bites into the valve housing 24 with a biting edge, and at the other end, the spring is supported against the nozzle needle 30 by means of a spring plate 48 that is slid onto the nozzle needle 30. The spring plate 48 is supported against a retaining ring 50 inserted into a circumferential groove of the nozzle needle 30.

The spring chamber 44 is fed by a bore 52, which is embodied in the housing assembly 20 and into which fuel is introduced, essentially at the rail pressure, via the associated fuel supply line 14. From the spring chamber 44, the fuel travels via the annular chamber 40 into the vicinity of the needle seat 36. In axial regions in which the nozzle needle 30 rests against the circumference wall of the guide bore 28 for guidance purposes, the fuel flows past one or more flattenings 54 of the nozzle needle circumference.

A control chamber 58, which is fed by an inlet conduit 62 equipped with an inlet throttle 60, is defined by the sleeve 46, the valve housing 24, and an end face 56 of the nozzle needle 30 remote from the combustion chamber. Fuel can flow from the spring chamber 44, through the inlet conduit 62, and into the control chamber 58. By means of an outlet conduit 66 equipped with an outlet throttle 64, fuel can flow from the control chamber 58 to a relief chamber that is not shown in detail.

A shutoff valve 70, which can be actuated by means of an electromagnetic or preferably piezoelectric actuator 68 that is only indicated schematically, makes it possible for the outflow of fuel to the relief chamber to be shut off.

Because of the prestressing spring 42 and the pressure, which prevails in the control chamber 58, acting on the needle end face 56, an axial closing force directed toward the combustion chamber is exerted on the nozzle needle 30. This closing force axially counteracts an opening force, which is exerted on the nozzle needle 30 due to the action of the pressure prevailing in the spring chamber 44 and the annular chamber 40 on a stepped surface 72 embodied on the nozzle needle 30. If the shutoff valve 70 is disposed in a closed position and if the outflow of fuel through the outlet conduit 66 is consequently shut off, then in the stationery state, the closing force is greater than the opening force, as a result of which the nozzle needle 30 then assumes its closed position. If the shutoff valve 70 is then opened, fuel flows out of the control chamber 58.

The flow cross sections of the inlet throttle 60 and the outlet throttle 64 are matched to each other so that the inflow through the inlet conduit 62 is weaker than the outflow through the outlet conduit 66 and therefore results in a net outflow of fuel. The subsequent pressure drop in the control chamber 58 causes the closing force to drop below the opening force and the nozzle needle 30 lifts up from the needle seat 36.

If the injection is to be terminated, the shutoff valve 70 is brought back into a closed position. This stops the outflow of fuel through the outlet conduit 64. Fuel continues to flow from the spring chamber 44 into the control chamber 58 by means of the inlet conduit 62, as a result of which the pressure in the control chamber 58 builds up again. As soon as the pressure in the control chamber 58 reaches a level at which the closing force is greater than the opening force, the nozzle 30 moves into its closed position which prevents fuel from flowing out of the nozzle opening arrangement 38.

In order to achieve rapid needle closing speeds, a rapid pressure increase in the control chamber 58 must be provided after the shutoff valve 70 closes. The flow through the inlet conduit 62 is comparatively slight. An increase of the flow cross section of the inlet throttle 60, however, can only be considered within very strict limits because otherwise, there is the danger that when the shutoff valve 70 is opened, the net outflow of fuel is no longer sufficient to open the nozzle needle 30.

A bypass conduit 74 is therefore provided, by means of which an additional inflow of fuel into the control chamber 58 can be produced. The bypass conduit 74 branches from the bore 52 or from the spring chamber 44 and, just like the inlet conduit 62, is supplied with fuel that is essentially at the rail pressure.

The additional inflow of fuel through the bypass conduit 74 permits the pressure in the control chamber 58 to build back up to the level that is required to switch the nozzle needle 30 over from its open position into its closed position more rapidly than when the control chamber 58 is filled solely by means of the inlet conduit 62. In the final analysis, this allows the fuel quantity injected into combustion chamber to be more finely metered. This is clearly shown by the schematically quantity characteristic field depicted in FIG. 2.

Figure 2:
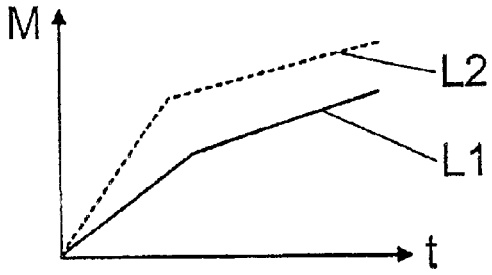

In FIG. 2, the abscissa is used to plot the time period t, during which the actuator 68 is electrically triggered in order to keep the valve 70 open. The ordinate indicates the fuel quantity M injected. The solid line L1 represents the relationship between triggering time and injection quantity when a bypass conduit 74 is provided, while the dashed line L2 shows this relationship when no bypass conduit is provided.

It is clear that the characteristic curve L1 is flatter than the characteristic curve L2. This means that with the same triggering time, less fuel comes out of the injection nozzle 16 when the bypass conduit 74 is provided. The reason for this is that after the power supply to the actuator 68 is shut off and after the valve 70 is closed, the nozzle needle 30 takes longer to return from its open position to its closed position when no bypass conduit 74 is provided than is the case when an additional fuel flow through the bypass conduit 74 accelerates the closing of the needle.

After the valve 70 is closed, the injection nozzle 16 is consequently open for a longer time when a bypass conduit 74 is not provided than when a bypass conduit 74 is provided. Correspondingly, the total output of fuel is also greater when no bypass conduit 74 is provided. The flatter characteristic curve L1 when a bypass conduit 74 is provided permits a finer metering of the fuel quantity injected and thus, results in an injector that is less tolerance-critical on the whole.

In the exemplary embodiment shown here, the shutoff valve 70 is embodied as a so-called double-switching directional control valve whose shutoff element 76—in this instance a spherical seat element—can be moved by the actuator 68, between two end positions and at least one intermediary position in a valve chamber 78.

In the two end positions or valve closing positions, the outlet conduit 66 is closed, preventing fuel from flowing out of the control chamber 58. By contrast, in the at least one intermediary position or valve opening position, it is open, permitting fuel to flow out of the control chamber 58.

This embodiment of the valve 70 makes it easy to produce a preinjection phase and a main injection phase. For the preinjection, the shutoff element 76 from a first one of the end positions into the second; for the main injection, it is moved from the second end position back into the first. The time during which the shutoff element 76 stops between the two end positions determines the fuel quantity injected for the preinjection and main injection. In particular, for the preinjection, the shutoff element 76 can be moved from the first end position into the second rapidly, i.e. without a long intermediary stop, so that only a small amount of fuel is injected. For the main injection, the shutoff element 76 can be kept in the intermediary position for a certain amount of time in order to permit a correspondingly greater quantity of fuel to come out.

It goes without saying that the actuator 68 for this must be designed as a positioning actuator, which also permits the shutoff element 76 to be moved into the at least one intermediary position.

The valve chamber 78 constitutes a flow connection between and upstream part 66'—with regard to the outlet direction of the fuel—and a downstream part 66" of the outlet conduit 66. A first valve seat 80 for the shutoff element 76, which is embodied as a spherical or flat seat element, is embodied at the infeed point of the downstream part 66" into the valve chamber 78; a second valve seat 82 is embodied in at the infeed point of the upstream part 66'. The contact of the shutoff element 76 against the first valve seat 80 defines the first of the two above-mentioned end positions; the contact against the second valve seat 82 defines the second end position. The shutoff element 76 can be spring-loaded into the first end position in a manner that is not shown in detail.

The bypass conduit 74 likewise feeds into the valve chamber 78. The embodiment of the valve 70 with two opposing valve seats 80, 82 then results in the fact that in the first end position of the shutoff element 76, i.e. in contact against the first valve seat 80, a fuel flow that accelerates the filling of the control chamber 58 can flow through the bypass conduit 74 into the upstream part 66' of the outlet conduit 66.

In the second end position, however, there can be no such flow of fuel. The entry into the upstream part 66' up of the outlet conduit 66 is closed by the contact of the shutoff element 76 against the second valve seat 82. However, this is not necessarily problematic because if the shutoff element 76 assumes the second end position only after preinjections, then the inflow of fuel solely via the inlet conduit 62 can be enough to compensate for the fuel losses from the pressure chamber 58 with sufficient speed. Namely, as a rule, only small fuel quantities flow out of the control chamber during a preinjection. These can be rapidly replaced even without the aid of the bypass conduit 74.

The outlet conduit 66 is embodied so that the fuel flowing out of the control chamber 58 cavitates in the outlet throttle 64. This has the advantage that the outflow of fuel is independent of the pressure prevailing in the valve chamber 78 and therefore is also unimpaired by a pressure increase in the valve chamber 78 that can occur with an open valve 70 as a result of the inflow of fuel via the bypass conduit 74.

The embodiment of the outlet throttle 64 itself is not the only thing responsible for the occurrence of cavitation. The downstream conduit section directly adjoining the outlet throttle 64 also significantly influences the occurrence of cavitation. Therefore, the outlet throttle 64 here is not disposed directly upstream of the valve chamber 78, but spaced apart from it. Between the outlet throttle 64 and the valve chamber 78, a so-called diffuser 84 is provided, which causes the cavitation to occur in the outlet throttle 64. If the bypass conduit 74 were to feed into the diffuser 84, flow edges at the infeed point would interfere with the occurrence of cavitation, if not completely preventing it. However, because the bypass conduit 74 feeds into the valve chamber 78 spaced apart from the diffuser 84, such interference with the cavitation production can be avoided.

The infeed angle at which the bypass conduit 74 feeds into the valve chamber 78 can also influence the outflow behavior of the fuel. In particular, an acute infeed angle of the bypass conduit 74 with regard to the outflow direction of the fuel can produce favorable results.

The bypass conduit 74 also contains a bypass throttle 86, whose embodiment is designed on the one hand, to permit the greatest possible inflow of fuel to the control chamber 58 and on the other hand, to permit the least possible leakage flows, which escape unused via the downstream part 66" of the outlet conduit 66 when the valve 70 is open or the shutoff element 76 is resting against the valve seat 82.

What is claimed is:

1. An injection device for a fuel reservoir injection system of an internal combustion engine, having an injection nozzle (16), which protrudes into a combustion chamber of the engine and can be supplied with fuel from a high-pressure fuel distributor (10) of the reservoir injection system by means of a high-pressure fuel supply path (14, 52,44, 40), and having a nozzle needle (30), which opens and closes the injection nozzle (16) as a function of the pressure in a control chamber (58), where in order to introduce fuel into the control chamber (58), an inlet conduit (62), which branches from the fuel supply path (14, 52, 44, 40), feeds into the control chamber (58) and an outlet path (66, 78), which leads from the control chamber (58), permits fuel to flow out of the control chamber (58), where a shutoff valve (70) is also provided, which can close a downstream section (66") of the outlet path (66, 78)—with regard to the outlet direction of the fuel—off from an upstream section (66') of the outlet path (66, 78), where the downstream section (66") and the upstream section (66') of the outlet path (66, 78) feed into a valve chamber (78), which contains a movable shutoff element (76) of the shutoff valve (70), and where a bypass conduit (74), which feeds into the outlet path (66, 78), branches from the fuel supply path (14, 52, 44, 40) in order to introduce an additional fuel flow into the control chamber (58), characterized in that the infeed point of the bypass conduit (74) into the outlet path (66, 78) is disposed in the vicinity of the valve chamber (78), the shutoff element (76) is embodied as a seat element that can be moved between two opposing valve seats (80, 82) in the valve chamber (78), the upstream section (66') and the downstream section (66") of the outlet path (66, 78) feed into the valve chamber (78) at the two valve seats (80, 82), and in that the infeed point of the bypass conduit (74) into the valve chamber (78)—with regard to the outflow direction of the fuel—is disposed between the two valve seats (80, 82).

2. The injection device according to claim 1, characterized in that an outlet throttle (64) disposed in the outlet path (66, 78) upstream of the valve chamber (78) is disposed spaced apart from the valve chamber (78) along the outlet path (66, 78).

3. The injection device according to claim 2, characterized in that the outlet path (68, 78), particularly in its region (84) between the outlet throttle (64) and the valve chamber (78), is embodied in such a way that when fuel flows out of the control chamber (58), cavitation occurs in the outlet throttle (64).

4. The injection device according to claim 1, characterized in that the bypass conduit (74) is always open.

5. The injection device according to claim 1, characterized in that the shutoff valve (70) is piezoelectrically actuated.

6. The injection device according to claim 1, characterized by means of its use as a component of a common rail injector.

* * * * *